US005255173A

United States Patent [19]

Schonbek

[11] Patent Number: 5,255,173

[45] Date of Patent: Oct. 19, 1993

[54] CHANDELIER ASSEMBLIES MADE OF INTERLOCKING COMPONENTS

[75] Inventor: Arnold Schonbek, Plattsburgh, N.Y.

[73] Assignee: Schonbek Worldwide Lighting Inc., Plattsburgh, N.Y.

[21] Appl. No.: 940,779

[22] Filed: Sep. 4, 1992

Related U.S. Application Data

[63] Continuation of Ser. No. 814,073, Dec. 24, 1991, abandoned, which is a continuation of Ser. No. 539,606, Jun. 18, 1990, abandoned.

[51] Int. Cl.[5] ..... F21S 1/06

[52] U.S. Cl. ..... 362/405; 362/406

[58] Field of Search ..... 362/339, 252, 405, 406, 362/404; 248/324, 343, 344; D26/72, 80, 81, 84, 85, 86, 88, 90, 142, 143, 144

[56] References Cited

U.S. PATENT DOCUMENTS

| | | | |
|---|---|---|---|
| 1,530,993 | 3/1925 | Framburg | 362/406 |
| 1,534,662 | 4/1925 | Riddle | 362/405 |
| 1,629,489 | 5/1927 | Dvorak | 362/406 |
| 1,644,452 | 10/1927 | Spencer | 362/408 |
| 1,668,772 | 5/1928 | Kestell | 362/405 |
| 2,437,350 | 3/1948 | Ferlin et al. | 362/241 |
| 4,107,770 | 8/1978 | Weber | 362/405 |
| 4,477,866 | 10/1984 | Goralnik | 362/405 |

FOREIGN PATENT DOCUMENTS

| | | | |
|---|---|---|---|
| 572602 | 11/1958 | Belgium | 362/405 |
| 0179638 | 4/1986 | European Pat. Off. . | |
| 1212045 | 3/1960 | France . | |
| 1487840 | 7/1967 | France . | |
| 2445486 | 7/1980 | France . | |
| 2057112 | 3/1981 | United Kingdom . | |

*Primary Examiner*—Stephen F. Husar
*Attorney, Agent, or Firm*—Wolf, Greenfield & Sacks

[57] ABSTRACT

Novel chandelier frameworks are provided. The chandelier frameworks include arms and plates, as well as rings and disks mechanically and disengagingly securing the parts of the framework to one another. The plates and arms may include interlocking slots and projections held together by locking disks.

28 Claims, 10 Drawing Sheets

CHANDELIER ASSEMBLIES MADE OF INTERLOCKING COMPONENTS

This application is a continuation of application Ser. No. 07/814,073, filed Dec. 24, 1991, now abandoned, which in turn is a continuation of application Ser. No. 07/539,606, filed on Jun. 18, 1990, now abandoned.

FIELD OF THE INVENTION

The invention relates generally to chandeliers and more particularly to chandelier assemblies made of slotted interlocking components.

BACKGROUND OF THE INVENTION

In the manufacture of chandelier frameworks, assemblies made of arms radiating from a central region are required. Such arms may radiate from the center unsupported at the outer end, thus forming a rimless wheel, or may be joined at the outer end to a ring, thus forming a wheel. In other applications, outwardly radiating spokes may return to a second center at a different level, thus forming a cage. In connection with chandelier frameworks, the arms are customarily attached to a central location such as, for example, a round disk by various means including welding or soldering the arms directly to the center disk. A disadvantage of this method is the impossibility of removing the arms when repair is necessary. Other disadvantages include the high cost of soldering or welding spokes due to the requirement of skilled labor, the need for accurate jigs, and the like. Arms have also been held to such central disks by soldering or welding screws onto an end of each of the arms and then fastening the arms to the disk by passing these screws through holes in the disk. The screws are then secured by lock nuts. Disadvantages of this method of attachment include the lack of structural strength, the high cost of soldering or welding the screws onto the spokes and the requisite skilled labor for such operations, the need for accurate jigs, the sideways motion and misalignment of the arms in the case of loosened nuts, and the like.

Arms have also been riveted, eyeletted, or flanged to a disk. Again, there are many disadvantages including the lack of structural strength, attachment of arms to the disk with external fasteners that greatly reduce the weight-supporting strength of the arms, sideways motion of the arm when the rivet, eyelet or flange loosens, and the like. Furthermore, chandelier framework assemblies cannot be effectively manufactured from plastic or other modern synthetic materials according to any of the foregoing assembly methods.

When tubular arms are attached to disks, a complex procedure typically has been followed. First the tubing is rounded, using a cylindrical rotating pin and a lathe or drill press. Female threads then are cut into the rounded ends of the tubing and then a variety of means may be used to attach the threaded end of the tubing to the disks. Disadvantages abound. If a threaded tubing is attached to a disk by means of a lock nut and secured by a lock washer, the tubing has to be accurately oriented. The screwed connection is subject to various failures such as the stripping of the thread in the process of tightening it or the loosening of the lock nut as a result of handling or vibration, resulting in disorientation of the arm and, possibly, separation of the arm from the disk. Costly machining operations such as beading and threading and the lengthy procedure of attaching a beaded and threaded arm to a disk are further disadvantages typical of prior art methods.

SUMMARY OF THE INVENTION

The foregoing difficulties are overcome by the present invention which provides novel chandelier frameworks including arms, disks and rings mechanically and detachably held together without the use of welds, screws, rivets, eyelets, and the like. According to one aspect of the invention, the chandelier framework includes plates and arms held together by interlocking plate slots and arm slots. Slotted arms are introduced into plate slots and the arms are then moved laterally with respect to the plate slots to interengage the arm slots with the plate slots. Then, the arms are locked against lateral movement within the slots to prevent disengagement of the arms from the plate. Preferably, the arms are secured from lateral movement within their respective slots by a second plate removably attached to the first plate. The second plate abuts a surface of the arms facing the open portion of the plate slots, thereby preventing any lateral movement of the arms within the plate slots. The arms may be flat or tubular. In certain preferred embodiments, the second plate engaging the arms is concave.

According to another aspect of the invention, the chandelier framework is assembled from a plate having plate slots and arms having projections, each projection extending into a respective plate slot. The arms and plate are held in face to face relation by a second plate secured to the first plate and engaging a surface of the arms for locking the arms to the first plate. In this manner, a plurality of arms may be locked in a predetermined array by a pair of plates sandwiching an end of the arms with at least one of the plates having slots interengaging with projections of the arms.

Novel methods for manufacturing a chandelier framework also are provided. According to one method, a plurality of slotted arms are attached to a first plate by moving the arms laterally with respect to the first plate, thereby interengaging the arm slots with the first plate. The arms are then locked against lateral movement with respect to the first plate, preferably by a second plate. The first plate may be a ring and the arms may be slotted at a radially outwardly disposed location. In this case, the arms are moved radially outwardly to interengage the arm slots with the ring. Then, an inwardly disposed end of the arms is secured against inward movement, preferably by securing the inwardly disposed ends of the arms to a central plate, thereby locking the arms to the ring. Preferably the inwardly disposed ends of the arms are secured to the second slotted plate by attaching a locking disk to the central slotted plate in a manner that prevents disengagement of the inwardly disposed end of the arms from the central plate.

As will be more evident from the detailed description that follows, the various aspects of the invention contribute significant advantages over the prior art. Not only are the chandelier frameworks of the invention manufactured easily and cost effectively, but they also may be easily dissembled to permit repair or replacement of damaged parts. Further, due to the use of interengaging slots or slots and projections, predetermined arrays of arms and rings may be precisely assembled in that the slots and projections precisely position and align the various parts of the framework with respect to one another. The invention applies to frameworks that may be constructed entirely of flat stock material such as flat spokes plates and rings, or from stock material including tubes of various shapes capable of housing wires for supplying electrical current to the ends of chandelier arms. The methods of manufacture may be applied to construct integral frameworks hidden from view by chandelier trimmings, or external frameworks exposed to view.

BRIEF DESCRIPTION OF THE DRAWINGS

The foregoing objects and advantages as well as others will be more apparent with reference to the drawings in which:

FIG. 12(*b*) is a cross sectional view along a slot of the tubular arm of 12(*b*).

FIG. 15(*b*) is a perspective view of the slotted square arm of FIG. 15(*a*).

DETAILED DESCRIPTION OF THE PREFERRED EMBODIMENTS

The invention involves novel chandelier frameworks including plates and arms mechanically and detachably locked together in precise relation. As used herein, the term arm is intended to include tubular arms having virtually any cross section including round, square, rectangular, oval, and the like. The term arm is also intended to include flat arms such as scrolls or spokes. As used herein the term plate is intended to include any part constructed of substantially flat material, which material may be slotted with open or closed slots. The term plate as used herein also is intended to include flat material having holes therein, including holes large enough such that the plate would be considered to be a ring of annular or oblique, non rounded, shape.

Figure 1:
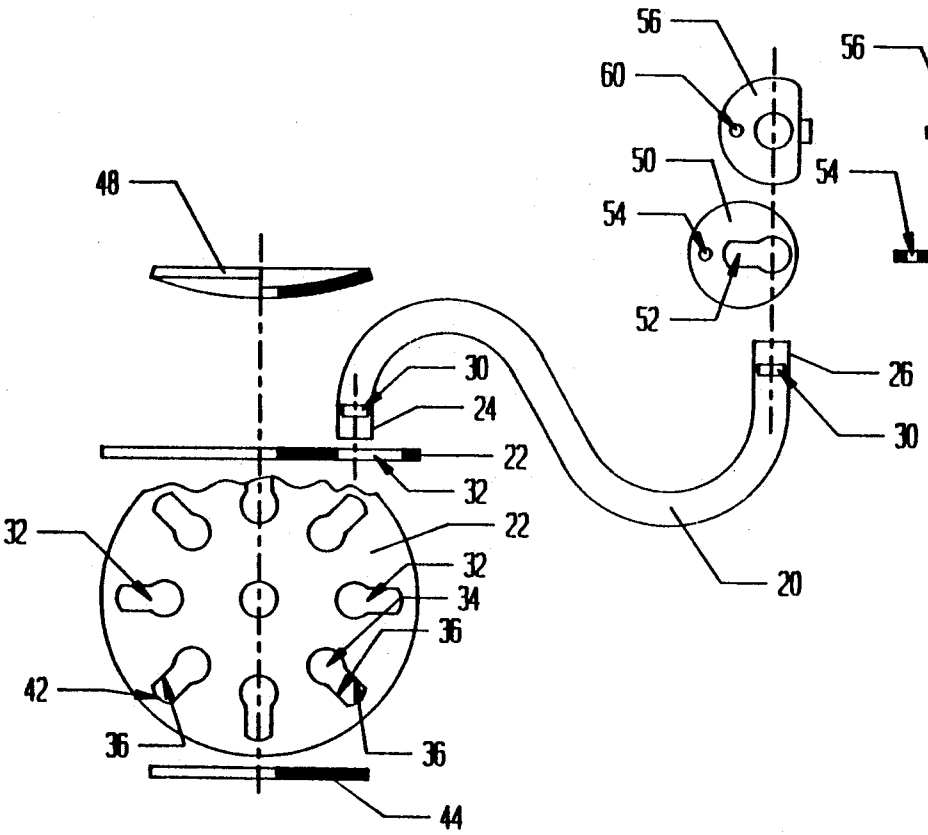
FIG. 1 is an an exploded cross sectional view of a chandelier framework having tubular arms.

FIG. 1 illustrates a chandelier framework according to the invention formed from tubular arms 20 adapted for attachment to a center plate 22 to form an array of arms extending radially from the center plate 22. The tubular arms have an inner end 24 for attachment to the center plate 22 and an outer end 26 for attachment to a light socket assembly 28. The inner and outer ends 24, 26 of the tubular arms 20 are provided with transverse parallel slots 30 (FIG. 2) which are adapted and sized for interengagement with plate slots 32. The plate slots 32 are shaped generally like a keyhole, that is, one end of the plate slot being defined by a radius extending approximately three quarters of a full circle and the other end of the plate slot defined by parallel straight walls, the distance between the parallel straight walls being less than the diameter of the partial circle.

The configuration of the parallel slots 30 of the tubular arms 20 and the plate slots 32 shown in FIG. 1 is such that they may be interengaged with one another in a slip fit to precisely position and hold the arms in a predetermined radial array with respect to the center plate 22. The circular portion 34 of the plate slots 32 has a diameter slightly larger than the diameter of the tubular arms 20 so that the slotted end of the tubular arms 20 may be passed axially through the plate slots 32. The distance between the parallel walls 36 defining the outwardly disposed portion of the plate slot 32 is slightly greater than the cross-section 38 of the slotted portion of the tubular arms 20. The parallel slots 30 of the tubular arms also have facing walls 40 defining a slot width which is slightly greater than the thickness of the center plate 22. Given these parameters, the tubular arms 20 may be locked to the center plate 22 by interengaging the parallel slots 30 of the tubular arms with the plate slots 32. To do this, the inner ends 24 of the tubular arms 20 are inserted axially through the plate slots 32 and positioned with the parallel slots 30 lying in the same plane as the plate slots 32. The tubular arms 20 are oriented radially such that the parallel slots 30 are parallel to the parallel walls 36 of the outwardly disposed portion of the plate slots 32. The tubular arms are then moved radially outwardly such that the facing walls 40 of the parallel slots 30 engage the surfaces of the center plate 22 adjacent the parallel walls 36 of the center plate slots 32. At this point of assembly, the facing walls 40 of the tubular arms 20 prevent axial movement of the tubular arms 20 with respect to the center plate 22. The outwardly disposed slot walls 42 also prevent the tubular arms from moving further radially outwardly.

The tubular arms 20, however, are still free to move radially inwardly. To prevent such movement, a lower locking disk 44 is secured in face to face relation with the downwardly facing surface of the center plate 22. The lower locking disk 44 in its simplest form is a disk sized to abut the inwardly facing surfaces 46 (FIG. 3) of the ends of the tubular arms 20 which extend through the center plate 22. Such a locking disk 44 may be round or may be slotted with partial open or fully enclosed slots for mating with the ends of the tubular arms 20. The lower locking disk 44 then prevents radially inward movement of the arms with respect to the plate slots. The lower locking disk 44 and the center plate 22 preferably are provided with a central screw hole so that the lower locking disk 44 and center plate 22 may be fastened in face to face relation with one another by a nut and bolt arrangement.

The framework shown in FIG. 1 preferably may be provided with an upper locking disk 48 which is positioned substantially in face to face relation with the upwardly facing surface of the center plate 22. In this manner, the lower locking disk 44 and the upper locking disk 48 sandwich the center plate 22. The upper locking disk has the purpose of "shake-proofing" the assembly, that is, it is concave in shape and sized such that its outer perimeter presses against the tubings (which in a normal construction are flaring outwardly) in a downward direction. Preferably, the upper locking disk 48 is made of hard steel and has a serrated edge.

Figure 3:
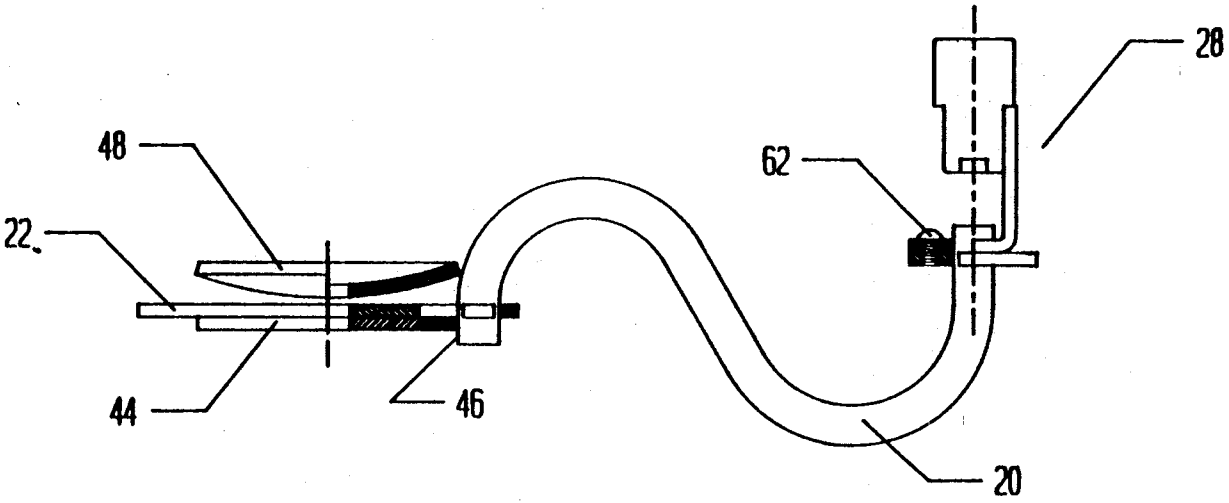
FIG. 3 is a cross sectional view of the assembled chandelier framework of FIG. 1.

Again referring to FIG. 1, the outer end 26 of each of the tubular arms 20 is also provided with parallel slots 30 for attachment to a light socket assembly 28. The light socket assembly includes a base plate 50 including a keyhole shaped plate slot 52 and a screw hole 54 adjacent to the plate slot 52. The light socket assembly 28 also includes a locking plate 56 to which is attached a light socket 58. To put together the light socket assembly 28, the parallel slots 30 at the outer end 26 of the tubular arms 20 are interengaged with the plate slots 52 in the same manner as described above. The locking plate 56 which carries the light socket 58 is then slipped over the outer end 26 of the tubular arm 20 and positioned such that the screw hole 60 of the locking plate is aligned with the screw hole 54 of the base plate 50. The base plate 50 and locking plate 56 then may be joined to one another for example, by a screw 62 (FIG. 3). Thus, according to this embodiment, the locking plate serves the dual purpose of restricting lateral movement of the tubular arm 20 with respect to the base plate 50 as well as providing a support for the light socket 58. A partially assembled framework of this type is depicted in FIG. 3.

Figure 4:
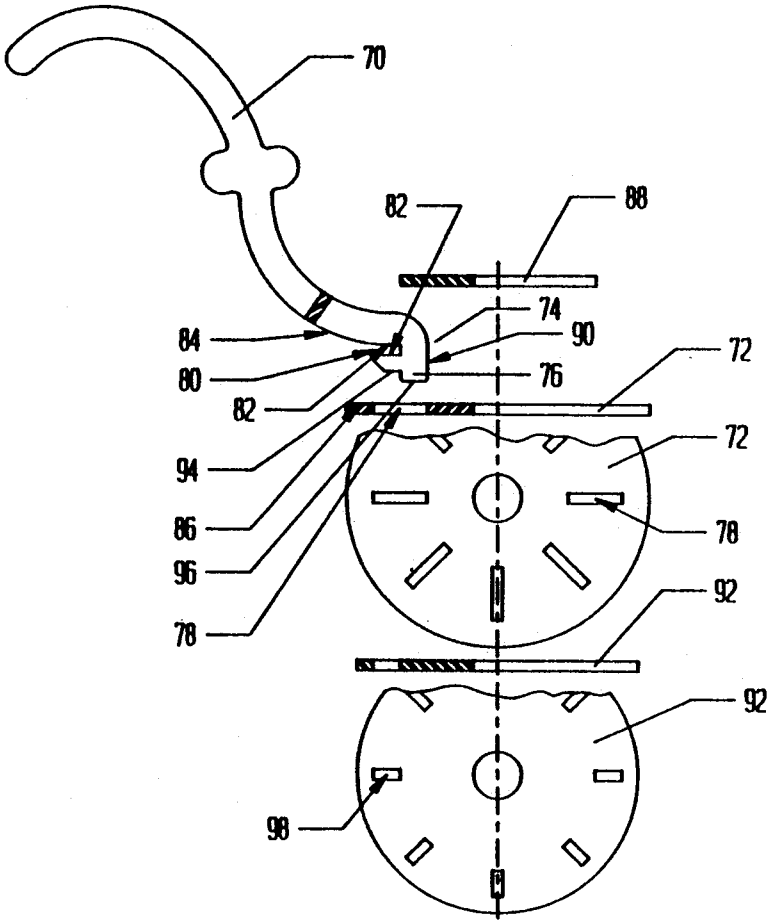
FIG. 4 is an exploded cross sectional view of a chandelier framework having flat arms and including a stabilizing locking plate.

According to another embodiment of the invention, a rimless chandelier frame may be constructed from flat arms or scrolls instead of tubular arms. Referring to FIG. 4, such an assembly may include scrolls 70 attached to and radiating in a predetermined array from a center plate 72. The inner end 74 of each scroll 70 defines a projection 76 sized to fit through mating rectangular plate slot 78. The projection 76 includes an outwardly facing open slot 80 which is generally rectangularly shaped, but without one of the shorter walls of the rectangle, thereby producing an open slot. The facing walls 82 defining the open slot 80 are spaced from one another at the distance slightly greater than the thickness of the center plate 72. The rectangular plate slots 78 and open slot 80, thus, are constructed and arranged such that they are capable of interengaging one another in a snug fit.

To assemble the chandelier framework of FIG. 4, the projection 76 of the inner end 74 of each scroll is aligned with and inserted through the rectangular plate slot 78 until the downwardly facing surface 84 of the scroll abuts the upwardly facing surface 86 of the center plate 72. The scrolls 70 are then moved radially outwardly with respect to the center plate 72 so as to interengage the open slot 80 of the scrolls with the center plate 72 along opposing surfaces of the center plate immediately adjacent, and outwardly disposed of, the rectangular plate slots 78. In this position, the scroll is incapable of both axial movement and radially outward movement with respect to the center plate 72. The scroll, however, still is capable of moving radially inwardly with respect to the center plate 72. To prevent such movement, an upper locking disk 88 is positioned and attached in face to face relation with the center plate 72 in a manner such that the upper locking disk contacts the plate slot facing surface 90 of the scroll that faces the open portion of the plate slot 78, thereby preventing radially inward movement of the scroll with respect to the plate. As described above, the locking disk may be secured to the plate by, for example, a nut and bolt arrangement.

Figure 5:
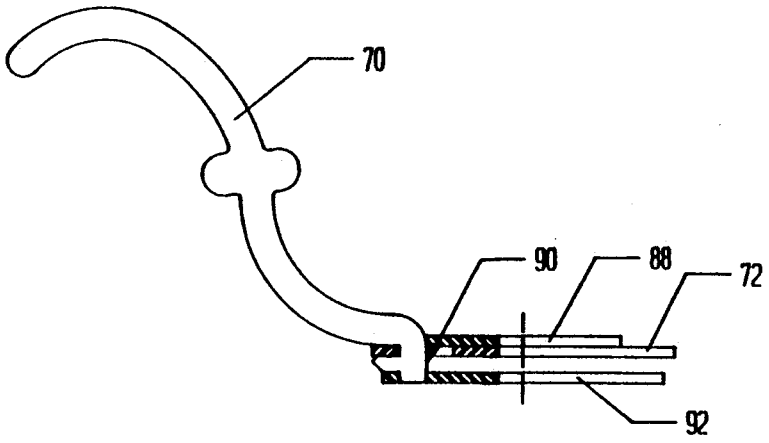
FIG. 5 is a cross sectional view of the assembled framework of FIG. 4.

The chandelier framework shown in FIG. 4 preferably is also provided with a lower locking disk 92 which provides further stability to the chandelier framework, and in particular assists in preventing sideways rocking of the scrolls 70 with respect to the surface of the center plate 72. Preferably, the lower locking disk 92 is spaced from the lower surface of the center plate 72 to provide greater stability. This may be accomplished by providing the inner ends 74 of the scrolls 70 with a platform 94 and a tip 96 extending from the platform. The lower locking disk 92 then may be provided with tip slots 98 for engagement with the tips 96. In this manner, the lower locking disk may be positioned over the ends of the scrolls 70 in mating relationship with the tips 96. In this position the lower locking disk 92 rests on the platforms 94 spaced from the downwardly facing surface of the center plate 72 (FIG. 5). The attachment of the lower locking disk to the center plate 72 and upper locking disk 88 may be accomplished by any suitable means such as, for example, by a nut and bolt arrangement.

Figure 6:
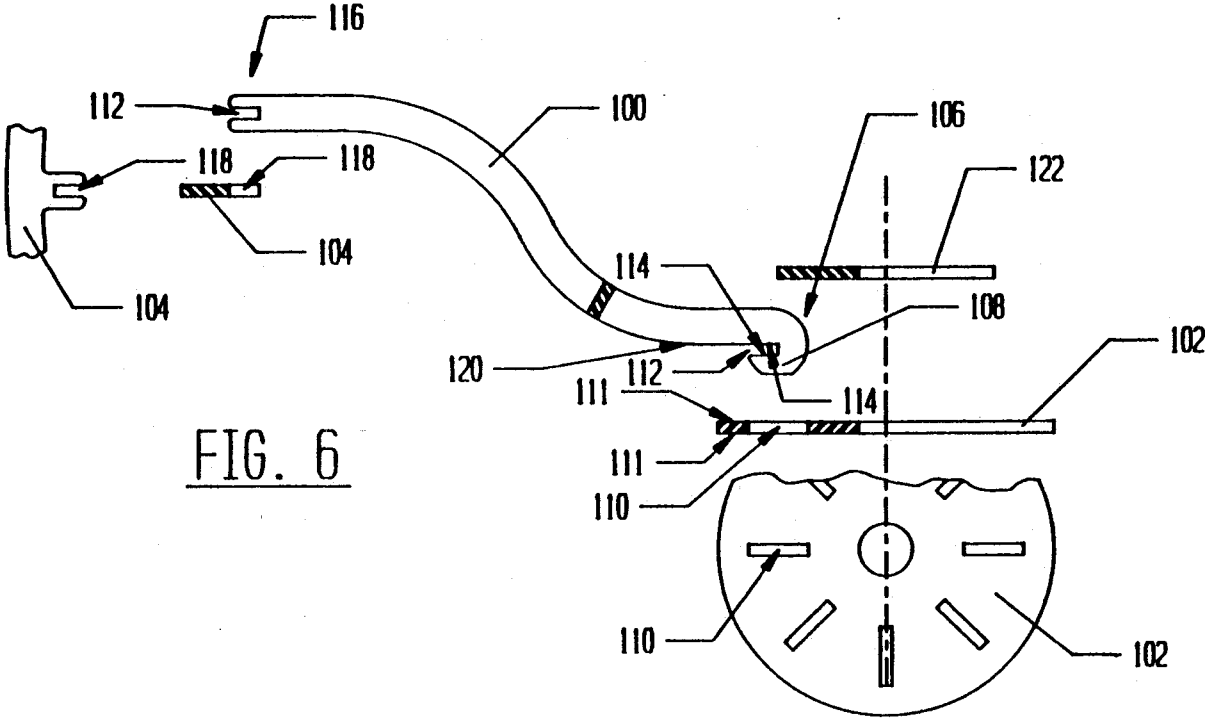
FIG. 6 is an exploded cross sectional view of a chandelier framework having flat slotted arms locked at one end to a slotted plate and at the other end to a slotted ring.

According to another embodiment of the invention (FIGS. 6 and 7), a rimmed chandelier framework is provided. In this embodiment, arms acting as spokes 100 are attached in a predetermined array to a center plate 102 generally as described above in connection with FIGS. 4 and 5, except that a lower locking disk for stabilizing the spokes against rocking movement with respect to the plate is not provided. Instead, the spokes are attached at their outer end (or at any region located radially outwardly from the center plate) to a ring 104 which may be adapted for supporting chandelier ornaments. The attachment of one ring is only an example since several rings of differing diameters may simultaneously be attached to a multi-segmented spoke according to this embodiment. Referring to FIG. 6, each of the spokes has an inner end 106 defining a projection 108 sized such that it may fit through rectangular plate slots 110. The projection 108 is provided with an outwardly facing open slot 112. As described above, the open slot 112 is sized with respect to the thickness of center plate 102 such that the projection 108 may be inserted through the rectangular plate slots 110 and then moved radially outwardly so as to interengage the facing walls 114 (defining the open slot of projectin 108) with the surfaces 111 of the center plate 102 which ar located immediately adjacent and radially outward of the rectangular plate slots 110. The outwardly disposed end 116 of the spoke 100 also include an outwardly facing open slot 112 for interengagement with an inwardly facing open slot 118 on the ring 104 (FIG. 6).

To assemble the frame, the projections 108 at the inner end 106 of the spokes 100 are inserted through the rectangular plate slots 110 until the downwardly facing spoke surface 120 rests on the upwardly facing surface of the center plate 102. The spokes 100 then are moved radially outwardly with respect to both the center plate 102 and the ring 104 so as to interengage the outwardly facing open slots 112 of the inner and outer ends of the spokes 100 with the center plate 102 and ring 104 respectively. After all the spokes have been positioned, then a locking disk 122 is positioned in face to face relation with the center plate 102. The locking disk is sized such that its perimeter abuts a surface of the spokes 100 adjacent and facing the open portion of the rectangular plate slots 110 so as to prevent radially inward movement of the spokes 100 with respect to the center plate 102. In this manner, the spokes 100 are locked against axial and lateral movement.

Figure 7:
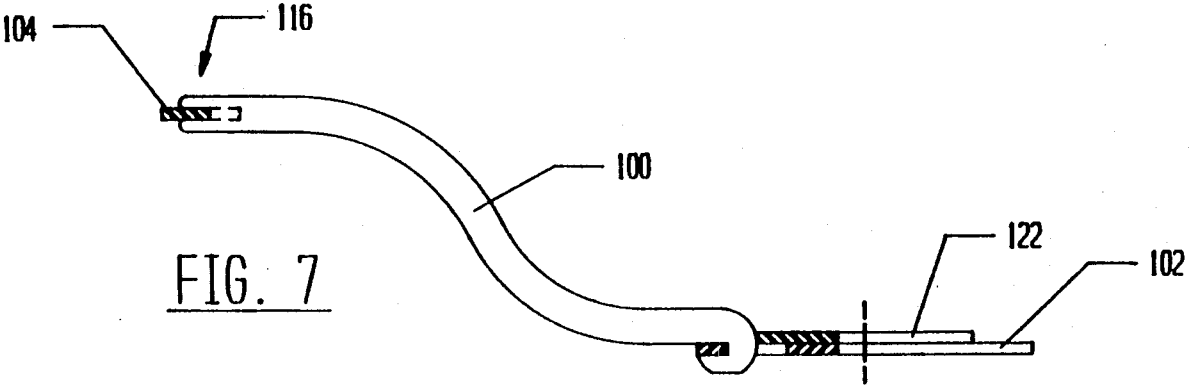
FIG. 7 is a cross sectional view of the assembled chandelier framework of FIG. 6.
Figure 8:
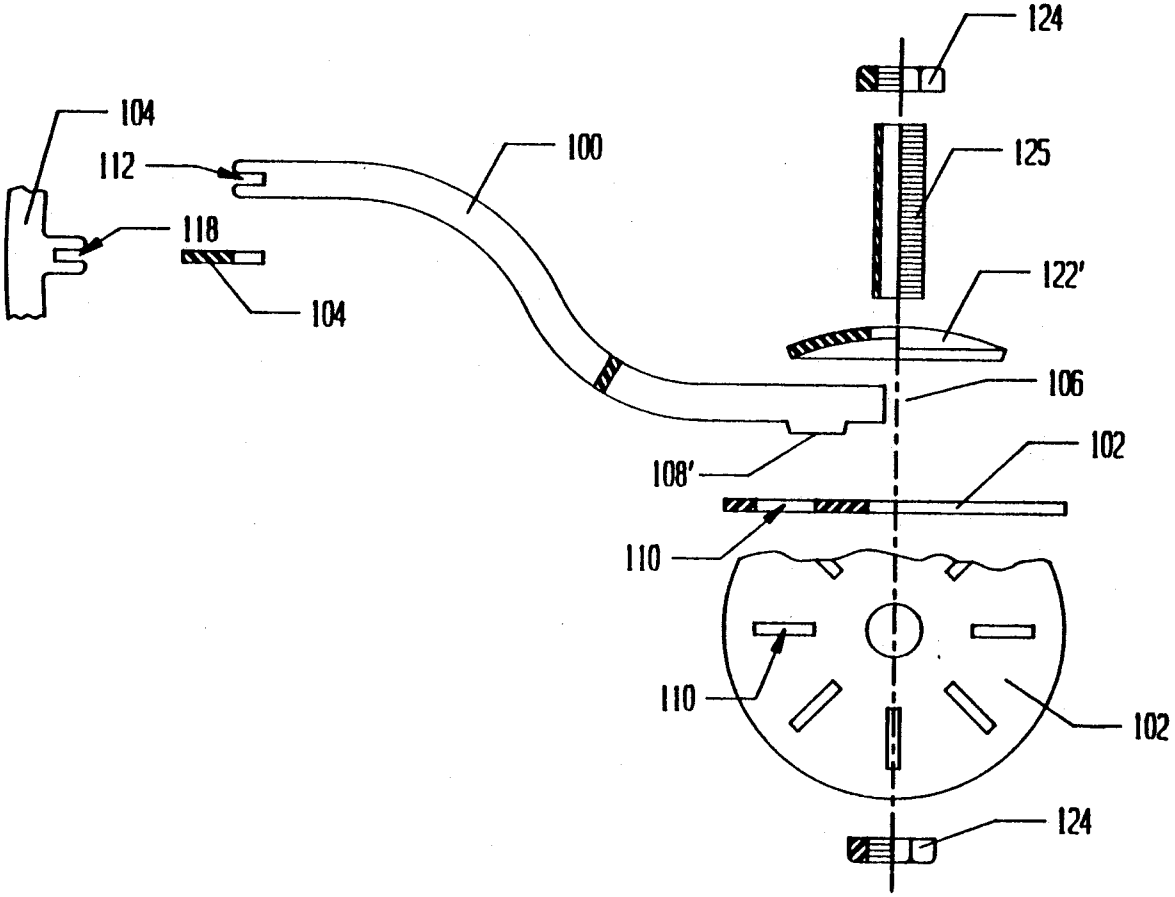
FIG. 8 is an exploded cross sectional view of a chandelier framework having flat arms with an alignment projection at one end for attachment to a slotted disk and a slot at the other end for attachment to a slotted ring.

A modification of the embodiment shown in FIG. 7 is illustrated in FIG. 8. In this embodiment, the projection 108' at the inner end 106 of the spoke does not include a slot. Rather, the projection 108' is sized to fit snugly within the rectangular plate slots 110. As such, the projection 108' is incapable of any lateral movement within the rectangular plate slots 110, including radial movement. Thus, the locking disk 122 of FIG. 7 is not required in this embodiment. However, because the spokes 100 do not have slots at their inner end 106, a locking disk 122' is required for preventing the inner ends 106 of the spokes 100 from moving axially upwardly and out of the slots 110 with respect to the center plate 102. The locking disk 122 in this embodiment then is positioned with respect to the center plate 102 so as to sandwich the inner ends 106 of the spokes between the locking disk 122' and the center plate 102. The preferred locking disk 122' is a downwardly facing concave disk attached to the center plate 102 for example by a nut and bolt arrangement. The concavity provides extra spring force upon the surfaces of all spokes and allows tighter fastening of the nut 124 and bolt 125.

Figure 9:
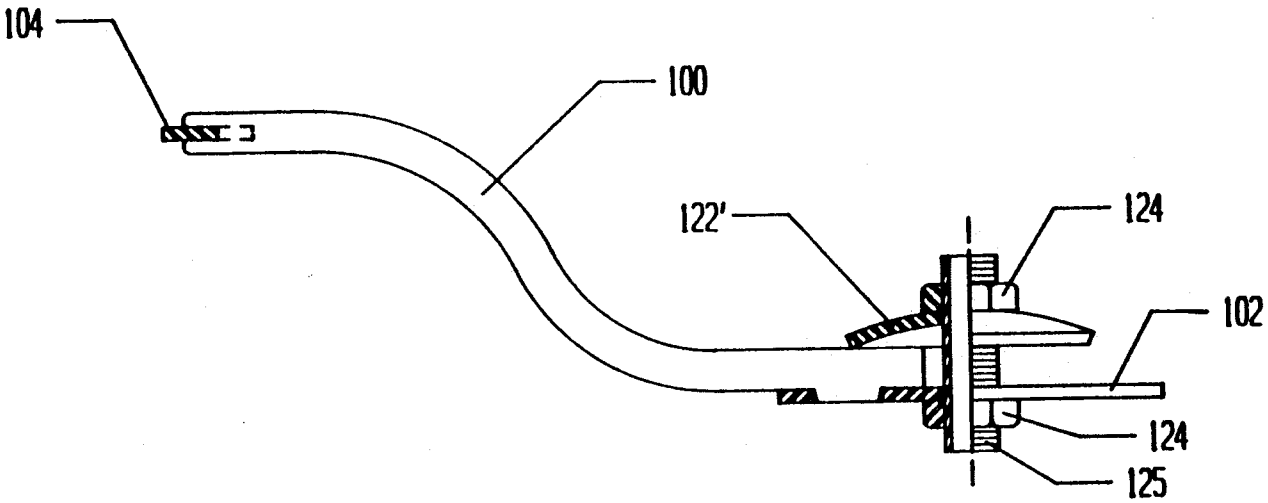
FIG. 9 is a cross-sectional view of the assembled chandelier framework of FIG. 8.

To assemble the device of FIG. 8, the spokes 100 are moved radially outwardly with respect to the ring 104 to engage the outwardly facing open slots 112 of the spokes with the inwardly facing open slots 118 of the ring. After the spokes 100 are attached to the ring, the projections 108' are inserted into the rectangular plate slots 110 of the center plate 102. Lastly, the concave locking disk 122' (preferably made of hardened steel with a serrated edge) is secured to the plate and forced downwardly by means of a lock nut 124 so as to sandwich the inner end 106 of the spokes 100 between the locking disk 122' and the center plate 102 and secure the spokes 100 against radially inward movement and detachment from the ring 104 (FIG. 9).

Figure 11:
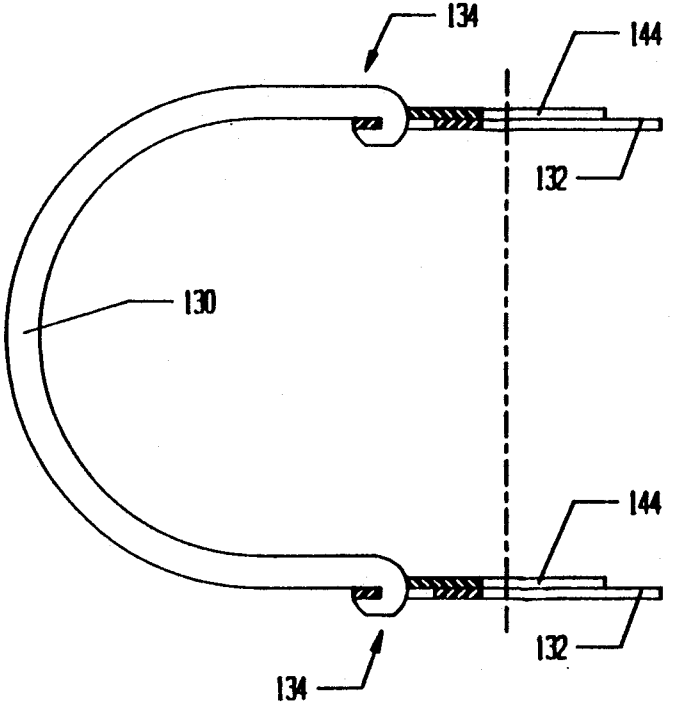
FIG. 11 is a cross sectional view of the assembled chandelier framework of FIG. 10.
Figure 10:
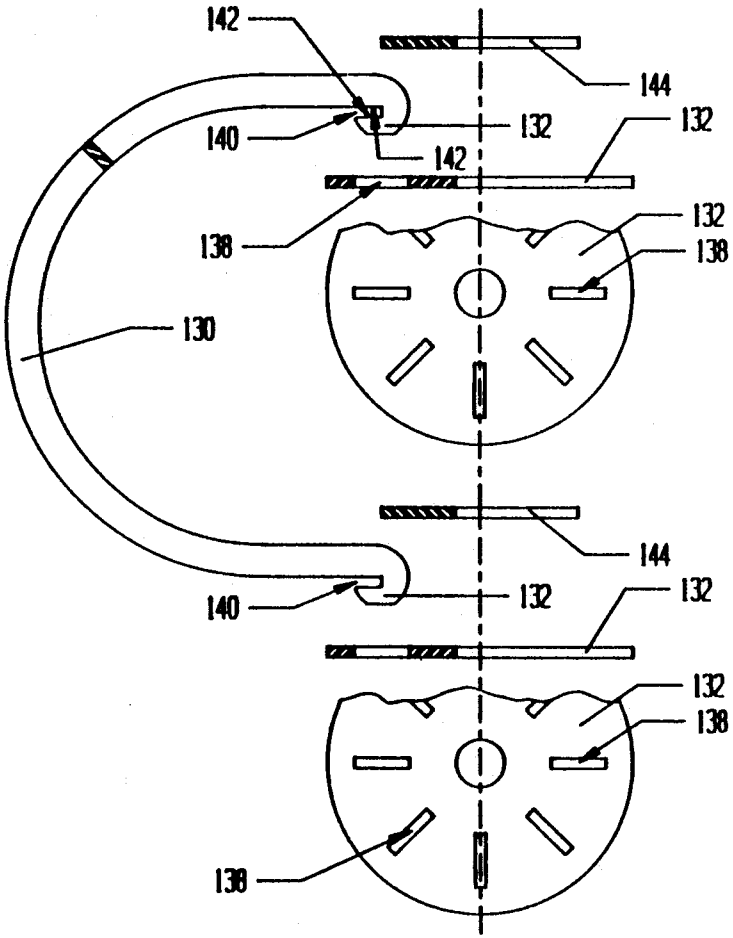
FIG. 10 is an exploded cross sectional view of a chandelier framework having u-shaped flat arms attached at opposite ends to slotted disks and forming a cage.

Another embodiment of the chandelier framework of the invention provides a cage assembly. Referring to FIGS. 10 and 11, the cage is constructed from an array of U-shaped spokes 130 attached at each of its ends to center plates 132. The center plates 132 are aligned upon the same. Each of the ends 134 of the spokes 130 defines a slotted projection 136 for interengagement with rectangular plate slots 138 in the center plates 132. As described above in connection with FIG. 7, the projections include open slots 140 for interengagement with the surfaces of the center plate 132 immediately adjacent and radially outward of the rectangular plate slots 138.

To assemble the cage, the slotted projections 136 are aligned with and inserted through the rectangular plate slots 138, with the open slots 140 of the spokes 130 facing radially outwardly. The spokes are then moved radially outwardly with respect to each of the two center plates 132 so as to interengage the facing surfaces 142 of the open slots 140 with the surface of the disk immediately adjacent and radially outward of the rectangular plate slots 138. The spokes 130 in this position are locked against axial movement with respect to the plates and lateral movement with respect to the plates, except that the spokes 130 still are free move radially inwardly with respect to the plates. The spokes 130 then are locked against such radially inward movement with locking disks 144 which are attached in face to face relation with the center plates 132. The locking disks 144 are sized such that they abut a surface of the spokes 130 facing the open portion of the rectangular plate slots 138 and thereby prevent radially inward movement of the spokes with respect to the rectangular plate slots 138. The assembled arrangement is shown in FIG. 11. The center plates 132 may be secured to the locking disks by, for example, nut and bolt arrangements.

Figure 2:
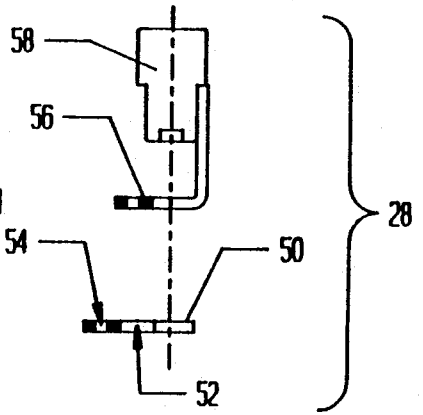
FIG. 2 is a perspective view of the slotted end of a tubular arm of FIG. 1.
Figure 2:
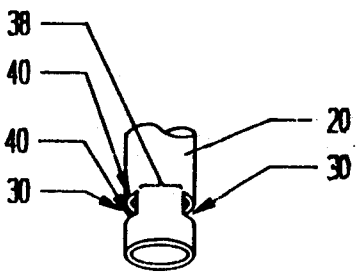
Figure 12A:
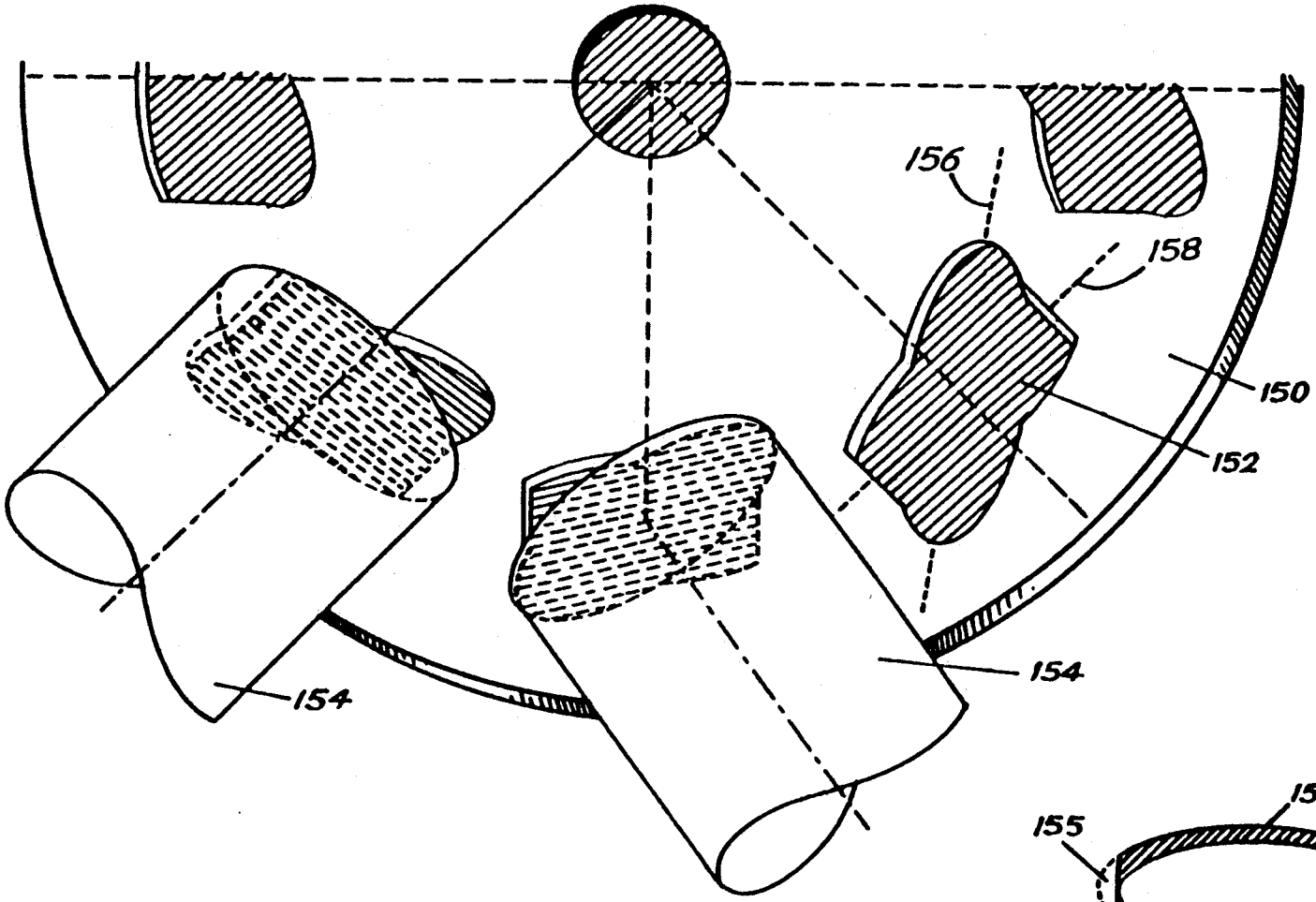
FIG. 12(*a*) is a partial plan view of a chandelier framework having slotted tubular arms attached to the turn slots of a slotted disk.
Figure 12B:
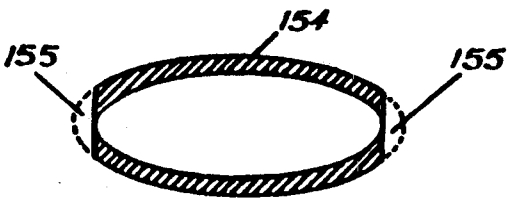

According to another aspect of the invention, chandelier frameworks including tubular arms are assembled by engaging slotted arms with plates having turn slots. Like the slots described in connection with FIGS. 1–3, a turn slot is a combination of two slots, one large enough to clear the profile of the unslotted tubing and another incapable of clearing the profile of the unslotted tubing, but capable of clearing the profile of the slotted tubing. A difference between this arrangement and that shown in FIGS. 1–3 is that to engage the slotted tubes with the turn slots of the plate, the tubes are twisted within the slots rather than being moved linearly with respect to a slot. Referring to FIG. 12(*a*), a partial plan view of a chandelier framework is shown as including a plate 150 having turn slots 152 and oval arms 154 having parallel slots 155 (FIG. 12(*b*); also see FIG. 2) positioned within the turn slots 152. The shape of the turn slot along axis indicated by dotted line 156 is sized to receive axially the unslotted tubing, while the turn slot along the axis defined by dotted line 158 will not receive axially the unslotted tubing.

Figure 14:
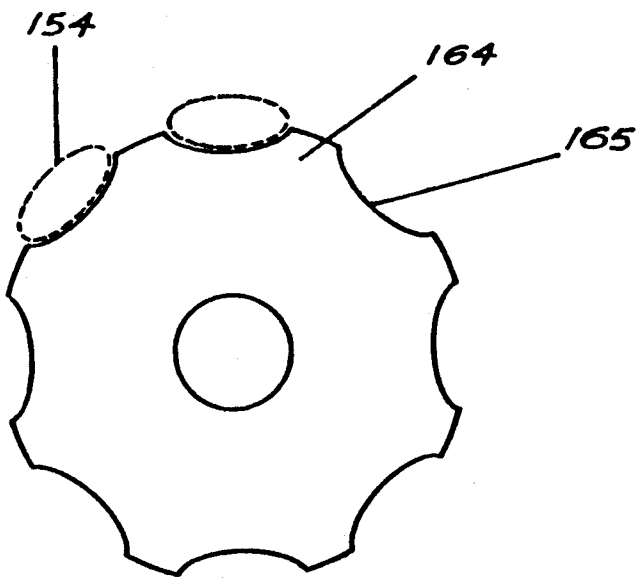
FIG. 14 is a top view of another locking disk capable of use with the chandelier framework of FIG. 12.
Figure 13:
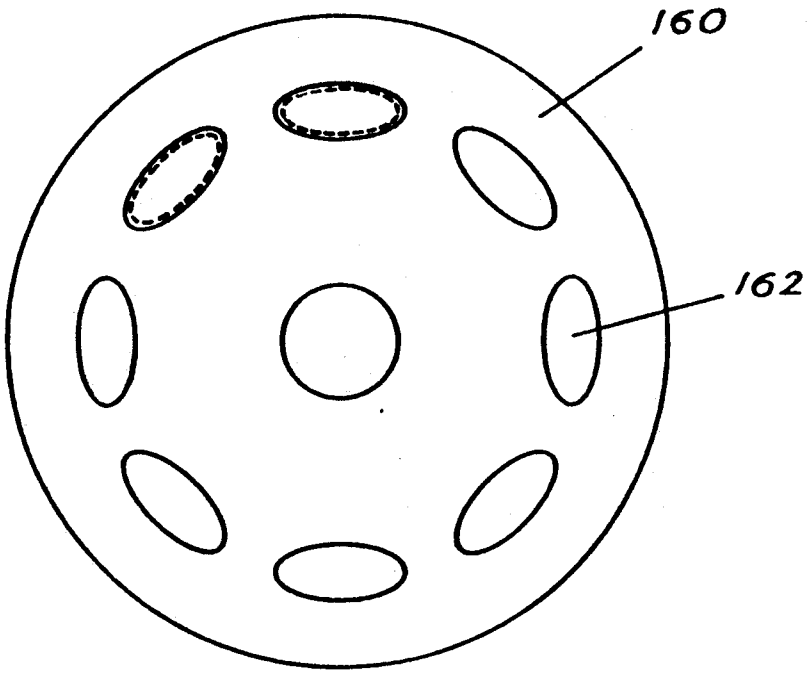
FIG. 13 is a top view of a locking disk for use with the chandelier framework of FIG. 12.

To assemble the frame, the oval arms 154 are inserted into the turn slots 152 along the axis defined by line 156 until the slots of the oval arms 154 are aligned with the edges of the turn slots 152 in the plate 150. This position is depicted by the oval arm 154 to the right in FIG. 12(*a*). The oval arm then is twisted into locking position such that the axis of the oval arm lies along the axis defined by the line 158. In this position (arm 154 to the left in FIG. 12(*a*)), the facing surfaces of the slots of the oval arms overlap and engage surfaces of the plate 150 adjacent the turn slots 152. To hold the oval arms 154 in locked position, a locking disk may be employed such as described above in connection with FIGS. 1–3. Such a locking disk 160 (FIG. 13) may include oval slots 162 sized to fit over the ends of the oval arms which extend through the plate 150. Another example of a locking disk 164 is depicted in FIG. 14. This locking disk 164 defines a perimeter 165 shaped to interengage the inwardly facing surfaces of the oval arms 154 and prevent the arms from lateral twisting relative to the plate 150 to thereby lock the arms 154 (shown in phantom) from disengagement from the plate 150. This second type of locking disk 164 may be useful for placing the locking disk 164 on the side of the plate from which bent arms project. A locking disk such as that in FIG. 13 would be unable to fit over such bent arms.

Figure 15A:
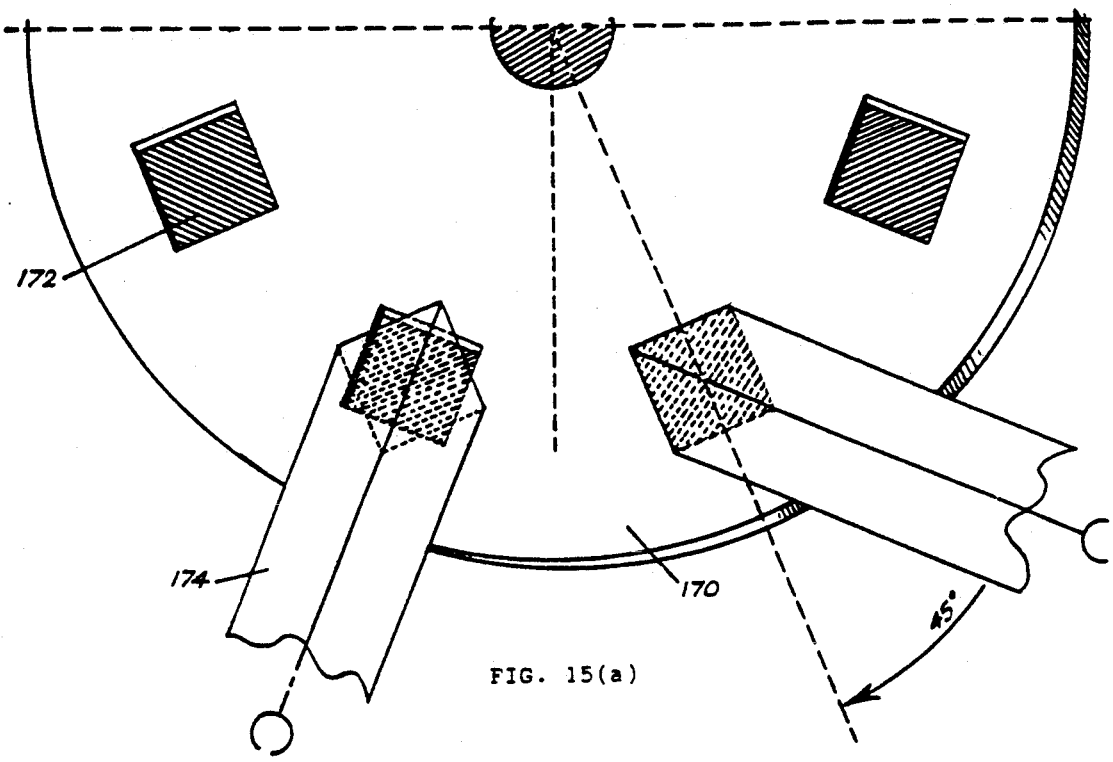
FIG. 15(*a*) is a partial plan view of a chandelier framework employing turn slots and slotted square arms.
Figure 15B:
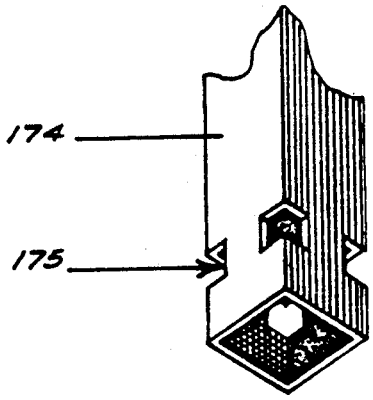

According to the turn slot aspect of the invention, the applicant does not intend to be restricted to oval shaped tubular arms. There are unlimited shapes which could function according to this aspect of the invention. For example, referring to FIG. 15(*a*), the plate 170 may include square turn slots 172 which interengage with slotted, square tubular arms 174. The tubular arm 174 on the right hand side of FIG. 15(*a*) is shown inserted into the square turn slot 172 in the insert position. The tubular arm arms 174 on the left hand side of FIG. 15(*a*) is shown in the lock position with the slots 175 (FIG. 15(*b*)) engaging the surfaces of the plate 170 adjacent to the square turn slots 172.

It will be understood by those skilled in the art that various changes and modifications to the embodiments shown in the drawings and described above may be made within the scope of the invention. For example, while various locking disks have been described for preventing lateral movement of arms within slots, disks, per se, are not necessary. The exact configuration of the locking means will depend upon the configuration of the overall chandelier framework. The locking means, thus, may be of various shapes and constructions including plates, radially extending arms, wedges which extend into the open portion of the slot to prevent lateral movement of the arms within the slots and virtually any other type of stop means for preventing lateral movement. Likewise, the frameworks have been shown as including outwardly disposed rings. It will be understood, however, that such "rings" may take virtually any shape, including squares or irregular shapes. In general, such shapes will usually include a continuous perimeter. Thus, those skilled in the art will be able to ascertain, using no more than routine experimentation, many equivalents of the specific embodiments of the invention described herein.

These and all other equivalents are intended to be encompassed by the following claims.

I claim:

1. A chandelier framework comprising:

a first plate having plates slots and opposing plate surfaces, the surfaces being planar and parallel over at least a predetermined area of the plate, tubular arms having arm slots, each arm extending through a respective plate slot, each respective plate slot being positioned in the predetermined area and each arm extending through the respective plate slot along a direction that is substantially perpendicular to planes defined by the opposing plate surfaces in the predetermined area, with the arm slot engaging the opposing surfaces of the plate adjacent the respective plate slot, the arm slots and the plate slots being shaped with respect to one another to prevent rotational movement of the arms within the slots, and a second plate secured to the first plate, the second plate having at least one second plate surface that is substantially planar over a second predetermined area thereof, the second predetermined area engaging at least a portion of the predetermined area of the first plate along one of the opposing plate surfaces, and the second plate having a side edge abutting a surface of at least two arms for preventing lateral movement of the at least two arms within the plate slots.

2. A chandelier framework as claimed in claim 1 wherein the second plate is positioned in face to face relation with the first plate.

3. A chandelier framework as claimed in claim 1 wherein the second plate abuts a portion of each arm facing an open portion of each respective slot.

4. A chandelier framework as claimed in claim 2 further comprising a ring secured to the arms at a position radially removed from the plate.

5. A chandelier framework as claimed in claim 1 wherein the second plate is removably secured to the first plate.

6. A chandelier framework comprising:

a first plate having plate slots and opposing plate surfaces, tubular arms having arm slots, each arm extending through a respective plate slot, with the arm slot engaging the opposing surfaces of the plate adjacent the respective plate slot, the arm slots and plate slots being shaped with respect to one another to prevent rotational movement of the arms within the slots, a second plate secured to the first plate and abutting a surface of at least two arms for preventing lateral movement of the at least two arms within the plate slots, and a third plate, at least one of the second and third plates having slots for engaging the arms at a position remote from the first plate.

7. A chandelier framework as claimed in claim 6 wherein the second plate is removably secured to the first plate.

8. A chandelier framework comprising a first plate having plate slots and opposing plate surfaces, arms having arms slots, each arm extending through a respective plate slot, with the arm slot engaging the opposing surfaces of the plate adjacent the respective plate slot, a second plate secured tot he first plate and abutting a surface of the arms for preventing lateral movement of the arms within the plate slots, and means secured to the first plate and abutting the surface of the arms at a position remote from the first plate for stabilizing the arms against rocking movement.

9. A chandelier framework as claimed in claim 8 wherein the means secured to the plate is removeably secured.

10. A chandelier framework comprising:

a first plate having plate slots and opposing plate surfaces, tubular arms having arm slots, each arm extending through a respective plate slot, with the arm slot engaging the opposing surfaces of the plate adjacent the respective plate slot, the arm slots and plate slots being shaped with respect to one another to prevent rotational movement of the arms within the slots, wherein the plates slots are irregularly shaped, and a second plate secured to the first plate and abutting a surface of at least two arms for preventing lateral movement of the at least two arms within the plate slots.

11. A chandelier framework as claimed in claim 10 wherein the second plate is removably secured to the first plate.

12. A chandelier frame work comprising:

a first plate having plate slots and opposing plate surfaces, tubular arms having arm slots, each arm extending through a respective plate slot, with the arm slot engaging the opposing surfaces of the plate adjacent the respective plate slot, the arm slots and plate slots being shaped with respect to one another to prevent rotational movement of the arms within the slots, wherein the plate slots define a first section capable of receiving axially the arms and a second section incapable of receiving axially the arms, but capable of receiving laterally the arms when the arm slots engage the opposing surfaces of the plate adjacent the second section, and a second plate secured to the first plate and abutting a surface of at least two arms for preventing lateral movement of the at least two arms within the plate slots.

13. A chandelier framework comprising:

a first plate having plate slots, arms extending from the plate, each arm having a projection extending into its respective plate slot at each arm defining an arm surface in face-to-face relation with the plate, a second plate secured to the first plate and engaging a surface of at least two of the arms for locking the arms to the first plate, and the plate slots defining a first section capable of receiving axially the arms and a second section incapable of receiving axially the arms, but capable of receiving laterally the arms when the arm slots engage the opposing surfaces of the plate adjacent the second section.

14. A chandelier framework as claimed in claim 13 wherein the arms are flat.

15. A chandelier framework as claimed in claim 14 further comprising a ring secured to the arms at a position along the arms radially removed from the first plate.

16. A chandelier framework comprising:

a first plate having plate slots, arms extending from the plate, each arm having a projection extending into its respective plate slot at each arm defining an arm surface positioned in face-to-face relation with the plate, a second plate secured to the first plate and engaging a surface of the arms for locking the arms to the first plate, wherein the second plate is concave, and means secured to the first plate and abutting the surface of the arms at a position remote from the first plate for stabilizing the arms against rocking movement.

17. A chandelier framework as claimed in claim 16 wherein the means for stabilizing the arms against rocking movement comprises a third plate engaging the arms at a position remote from the first plate.

18. A chandelier framework as claimed in any one of claims 13 or 16 wherein the second plate is removable secured to the first plate.

19. A method for manufacturing a chandelier framework comprising:

attaching a plurality of slotted tubular arms to a first plate by moving the arms laterally with respect to the first plate thereby interengaging the arm slots with the first plate, the arm slots being constructed and arranged to prevent rotational movement of the arms within the slots, and then locking the arms against lateral movement with respect to the first plate by securing a second plate to the first plate, the second plate contacting at least two of the arms.

20. A method as claimed in claim 19 wherein the arms are mechanically locked against lateral movement.

21. A method as claimed in claim 19 wherein the first plate has plate slots and wherein the arms are moved laterally with respect to the first plate to interengage the arm slots with the plate slots.

22. A method as claimed in claim 19 wherein the first plate is a ring, the arms are slotted at a radially outwardly disposed location, and the arms are moved radially outwardly to interengage the arm slots with the ring, and wherein inwardly disposed ends of the arms are secured against inward movement to lock the arms to the ring.

23. A method as claimed in claim 19 wherein inwardly disposed ends of the arms are secured against inward movement by attaching them to a second slotted plate.

24. A method as claimed in claim 23 further comprising securing the ends of the arms to the second slotted plate using a locking disc.

25. A method for manufacturing a chandelier framework comprising:

engaging a plurality of first arms with preformed slots in a first plate to form a predetermined array of arms, locking a second plate to the first plate to secure the arms in a fixed relationship with respect to the first plate, the second plate contacting at least two of the first arms, and locking a structure to the first plate at a position remote from the second plate and abutting a surface of the arms for stabilizing the arms against rocking movement.

26. A method as claimed in claim 25 further characterized by removably locking the second plate to the first plate.

27. A method as claimed in claim 25 wherein the first plate is a ring, the arms are slotted at a radially outwardly disposed location, and the arms are moved radially outwardly to interengage the arm slots with the ring, and wherein the inwardly disposed ends of the arms are secured against inward movement by locking a third plate to the second plate.

28. A method for manufacturing chandelier framework comprising:

attaching a plurality of slotted arms to a first plate having plate slots by axially inserting the arms through the plate slots and then by laterally moving the arms with respect to the first plate thereby interengaging the arm slots with the first plate, the plate slots defining a first section capable of receiving axially the arms and second section incapable of receiving axially the arms, but capable of receiving laterally the arms when the arm slots engage the opposing surfaces of the plate adjacent the second section, the second section shaped to prevent rotation of the arms relevant to the plate, and then locking the arms against lateral movement with respect to the first plate by securing a second plate to the first plate, the second plate contacting at least two of the arms.

* * * * *